US005936170A

United States Patent [19]

Hanlin, Sr. et al.

[11] Patent Number: 5,936,170

[45] Date of Patent: Aug. 10, 1999

[54] SINTERED LIQUID PHASE STAINLESS STEEL, AND PREALLOYED POWDER FOR PRODUCING SAME, WITH ENHANCED MACHINABILITY CHARACTERISTICS

[75] Inventors: David J. Hanlin, Sr., Ridgway; Orville W. Reen, New Kensington, both of Pa.

[73] Assignee: Intech P/M Stainless Steel, Inc., Ridgeway, Pa.

[21] Appl. No.: 09/020,382

[22] Filed: Feb. 9, 1998

[51] Int. Cl.[6] ..... C22C 33/02

[52] U.S. Cl. ..... 75/246; 75/231; 75/243; 75/244; 75/252; 75/254; 419/11; 419/23; 419/38; 419/47; 419/57

[58] Field of Search ..... 75/243, 244, 246, 75/252, 254, 231; 419/11, 38, 47, 57

[56] References Cited

U.S. PATENT DOCUMENTS

| | | | |
|---|---|---|---|
| 3,980,444 | 9/1976 | Reen | 29/182 |
| 4,014,680 | 3/1977 | Reen | 75/5 BA |
| 4,028,094 | 6/1977 | Reen et al. | 75/5 BA |
| 4,032,336 | 6/1977 | Reen | 75/224 |

OTHER PUBLICATIONS

S. Nigarura, et al. The Influence of Powder Process on the Nature of Inclusions and Its Relation to the Machinability of MnS Prealloyed P/M Parts. Metal Powder Industries Federation. 105 College Rd. East, Princeton, New Jersey 08540–6692, USA. 1992. 223–.

H. Sanderow, et al. The Effect of Manganese Sulfide on the Mechanical Properties of P/M Steels. Adv. Powder Metall. Part. Mater. (1993) vol. 4, Processing, Properties, and Applications, pp. 97–108.

S. St–Laurent, et al. The Effect of Sulfur Content on Machinability of Forged Specimens Made of Water Atomized Steel Powders Pre–Alloyed with MnS. Adv. Powder Metall. Part. Mater. vol. 2, 15/95–15/109, 1997.

*Primary Examiner*—Ngoclan Mai
*Attorney, Agent, or Firm*—Quinn, Buseck, Leemhuis, Toohey & Kroto, Inc.; Kenneth W. Wargo

[57] ABSTRACT

A blend of pre-alloyed stainless steel powder for use in producing sintered stainless steel, said powder consisting essentially of, by weight, up to 0.05% carbon, 22% to 26% chromium, 10% to 24% nickel, 2.7% to 5% molybdenum, 0.1% to 1% boron, up to 2.0% manganese, up to 2.0% silicon, balance iron and residuals, together with manganese sulfide particles added thereto until they comprise up to 4%, by weight, of the overall blend, experimental results having shown that the blend offers significant improvements in the machinability of the resulting steel. The patent also claims a method for making sintered steel using the blend, as well as the sintered steel resulting from the process.

11 Claims, No Drawings

SINTERED LIQUID PHASE STAINLESS STEEL, AND PREALLOYED POWDER FOR PRODUCING SAME, WITH ENHANCED MACHINABILITY CHARACTERISTICS

BACKGROUND OF THE INVENTION (a). Field of the Invention

This invention relates to a sintered liquid phase stainless steel with enhanced machinability characteristics. Essentially full density austenitic stainless steel parts are made starting from a powdered composition known from the prior art to which manganese sulfide powder has been added.

(b). Description of the Prior Art

Reference is made to prior U.S. Pat. Nos. 3,980,444 (Reen), 4,014,680 (Reen), and 4,032,336 (Reen). These patents disclose a sintered stainless steel having an overall density of at least 95% of full density and a morphology comprised of regions of sintered austenitic stainless steel and regions of solidified liquid phase. Conventional sintering is a process of metallurgically bonding metallic powder without melting. Generally speaking, the powder is first pressed into the desired part and then heated in an oven. The cited patents teach a sintered stainless steel having a composition consisting essentially of, by weight, up to 0.05% carbon, 22% to 26% chromium, 10% to 24% nickel, 2.7% to 5% molybdenum, 0.1% to 1% boron, up to 2.0% manganese, up to 2.0% silicon, and the balance iron and residuals. U.S. Pat. No. 4,014,680 discloses this composition as a pre-alloyed stainless steel powder to be used in the sintering process. U.S. Pat. No. 3,980,444 discloses the sintered stainless steel which results from this composition, and U.S. Pat. No. 4,032,336 discloses the method of making sintered stainless steel having this composition by using the said stainless steel powder. The patents further disclose that the use of the composition increases the density of the sintered stainless steel, resulting in increased resistance to corrosive attack by the chloride ion.

The composition and methods disclosed in the previous patents have proven their worth over many years of use. Reference may be made to American Society for Testing Materials Standard Specification ASTM B 853 covering stainless steel powder metallurgy structural components fabricated from pre-alloyed powder consisting primarily of iron, chromium, nickel, molybdenum and boron which are intended for use in corrosive service. The composition has also been given designation S31905 by the Unified Numbering System for Metals and Alloys.

Solid parts made according to the composition and process described in the three patents achieve high density by forming a liquid phase during the sintering process, known as liquid phase sintering. After the part has been liquid phase sintered, however, it is often still necessary to machine it. For example, the part may need to be machined to obtain a specific dimensional tolerance, or may require threading—something which cannot be done during the pressing process. Unfortunately, the material is difficult to machine. In this respect the sintered stainless steel parts according to the three previous patents have an austenitic microstructure similar to austenitic stainless steels in wrought form, such as bar stock, made by conventional steel-making processes using melting. Machinability shortcomings with wrought steel have been alleviated by introducing specific particles, both metallic and non-metallic, throughout the stainless steel matrix. These particles historically have been lead, selenium sulfide, and manganese sulfide. Because of toxicity concerns in the melting process, the production and use of wrought stainless steel containing lead and selenium sulfide have been declining, leaving manganese sulfide as the generally used material in the industry for improving the machinability of wrought stainless steel. In the normal melting practice of producing wrought stainless steel, manganese sulfide particles are produced by stoichiometric additions of manganese and sulfur for manganese sulfide formation. The manganese content of the molten metal for atomizing powder must be kept to a maximum of 0.15%. This would preclude the use of wrought austenitic stainless steel for remelt stock due to its high manganese content. If higher values of manganese are used in the melt, the resultant atomized powder is spherical in shape. Spherically shaped powders are very undesirable for making pressed and sintered parts because the parts may have little or no green strength. Therefore, manganese sulfide particles cannot be produced in the matrix of the atomized stainless steel powder by conventional melting procedures.

Accordingly, it is an object of the present invention to develop a procedure to produce manganese sulfide particles in the stainless steel matrix of the essentially fully dense parts produced from atomized pre-alloyed stainless steel powders. It is a further object of the invention to produce manganese sulfide particles in a stainless steel matrix by adding manganese sulfide particles to a pre-alloyed powder which is then pressed and sintered. It is a further object of the invention to produce a resulting sintered stainless steel with enhanced machinability.

DESCRIPTION OF THE PREFERRED EMBODIMENT

To applicants' knowledge, it is not possible to atomize stainless steels with high manganese contents into a molding grade powder because, as indicated above, the resultant atomized powder is spherical in shape. Applicants have been successful in producing an essentially full density pressed and sintered atomized, pre-alloyed stainless steel with manganese sulfide particles in its matrix by blending the stainless steel powder described in U.S. Pat. No. 4,014,680 with manganese sulfide powder, pressing, and sintering to essentially full density. The free energy of formation of manganese sulfide is greater than the free energy of the formation of sulfides of the other elements of the stainless steel composition. Thus, the manganese sulfide does not disassociate in the presence of the liquid phase and remains in the form of discrete particles. Testing on steel prepared from this composition has shown that it results in dramatically improved machinability. The presence of manganese sulfide particles also noticeably affects the surface morphology of sintered parts made from the material, as characterized by an increase in their reflectivity.

Tests were conducted to determine the machinability properties of a stainless steel powder mixture including manganese sulfide particles. Ten to twenty pound blends of atomized pre-alloyed stainless steel powder and manganese sulfide powder were prepared. Powder of the I-999 composition manufactured by the Ametek Company was used as the pre-alloyed stainless steel powder in the blend. The properties of the I-999 pre-alloyed stainless steel powder are shown in Table I. The properties of the manganese sulfide powder which was used are shown in Table II. Blends with varying manganese sulfide amounts of between 0.25% and 3.00% by weight added to the I-999 powder were prepared, as shown in Table III, which also shows the actual sulfur content of the various resulting blends. These values indicate that the blending operation provided the desired manganese sulfide contents in the mixtures. Blends with concentrations above 3% manganese sulfide could have been prepared but were not.

TABLE I

CHARACTERISTICS OF THE ATOMIZED PRE-ALLOYED METAL POWDER (AMETEK I-999) USED IN THE BLENDS

| CHEMICAL COMPOSITION, WEIGHT PERCENT | |
|---|---|
| Carbon: | 0.028 |
| Manganese: | 0.13 |
| Boron: | 0.26 |
| Nickel: | 17.43 |
| Oxygen: | 0.43 |
| Chromium: | 22.57 |
| Phosphorus: | 0.02 |
| Nitrogen: | 0.044 |
| Sulfur: | 0.015 |
| Molybdenum: | 3.69 |
| Silicon: | 0.80 |
| Iron: | Balance |

| POWDER PHYSICAL PROPERTIES (SIZE DISTRIBUTION) | | Percent |
|---|---|---|
| US Standard Mesh Size: | +100 | 3.4% |
| | +120 | 4.0% |
| | +140 | 6.6% |
| | +200 | 18.1% |
| | +270 | 21.6% |
| | +325 | 7.7% |
| | −325 | 38.6% |
| Apparent Density: | 2.87 grams/cubic centimeters | |
| Flow Rate: | 26 seconds/50 grams | |

TABLE II

ANALYSIS OF MANGANESE SULFIDE POWDER USED IN THE BLENDS

| | |
|---|---|
| Manganese: | 64.13% |
| Sulfur: | 35.97% |
| Other: | 00.75% |
| PHYSICAL PROPERTIES | |
| Particle Size | |
| Median = D50 | 4.98 microns |
| Top = D95 | 11.77 microns |

TABLE III

BLENDS OF I-999 POWDER AND MANGANESE SULFIDE POWDER

| Blend No. | Nominal MnS Added Percent[1] | Actual S Content Percent[2] |
|---|---|---|
| LX1 | 0.0 | 0.003 |
| LX2 | 0.25 | 0.052 |
| LX3 | 0.50 | 0.16 |
| LX4 | 0.75 | 0.23 |
| LX5 | 1.00 | 0.32 |
| LX6 | 1.25 | 0.41 |
| LX7 | 1.50 | 0.50 |
| LX8 | 1.75 | 0.58 |
| LX9 | 2.00 | 0.66 |
| LX10 | 2.50 | 0.80 |
| LX11 | 3.00 | 0.96 |

NOTES:
[1]Blends made by adding the stated percentage of MnS to 100% of I-999 (e.g., 3 g of MnS to 100 g of I-999).
[2]0.003% S in I-999 powder included in blend.

Each of the blends was used to produce parts such as might typically be produced in a sintering operation requiring later machining, namely, hexagonal rings approximately 0.62 inches outside dimension measured across the flats, 0.522 inches inside diameter, and 0.35 inches deep. The parts were double-action pressed to a green density of approximately 6.65 grams per cubic centimeter. All of the parts were then pre-sintered in a dry hydrogen atmosphere at 2200 degree fahrenheit in a continuous belt furnace and then vacuum sintered at 2275 degrees fahrenheit. The optional pre-sintering and vacuum sintering temperatures are dependent upon the exact chemical composition of the blend being used, with the preferred vacuum sintering temperature sometimes rising to approximately 2300 degrees fahrenheit.

Following this production, all of the parts were machined on a Southbend lathe, Model 1218 Magnaturn. The cutting tool used was an ISCAR Grade IC8025, positive seven degree clearance, 80 degree rhombic insert, ANSI designation CCMT 2-1-14. This is a cemented tungsten carbide insert with a cobalt-enriched ISCAR Grade IC-24S substrate which has been CVD coded with TiC/TiCN/TiN. Valenite® VNT 929, manufactured by Valenite, Inc., was used as the cutting lubricant. It is an alkaline, water-based cutting fluid concentrate.

The parts manufactured from the various blends were all machined in two passes. For the first pass, the feed was 0.0060 inches per revolution, the speed was 3550 rpms at 486 surface feet per minute, with a 0.009 inch depth of cut. For the second pass, the feed was 0.0049 inches per revolution, the speed was 3550 rpms, at 486 surface feet per minute, with a 0.0113 inch depth of cut. The parts were machined with a single-edge of the carbide insert until it no longer produced a satisfactory surface finish and/or size consistency. The insert was then rotated and another cutting edge was used.

Table IV summarizes the results of the machining tests performed on the blends. As can be seen, there is a strong correlation between the amount of manganese sulfide in the blend and the number of parts which were able to be machined per cutting edge.

TABLE IV

MACHINING TESTS

| BLEND NO. | MANGANESE SULFIDE ADDED (%) | PARTS MACHINED | CUTTING EDGES USED | PARTS MACHINED PER CUTTING EDGE |
|---|---|---|---|---|
| LX1 | 0.00 | 99 | 8 | 12.38 |
| LX2 | 0.25 | 278 | 8 | 34.75 |
| LX3 | 0.50 | 65 | 4 | 16.25 |
| LX4 | 0.75 | 351 | 5 | 70.20 |
| LX5 | 1.00 | 354 | 8 | 44.25 |
| LX6 | 1.25 | 425 | 8 | 53.13 |
| LX7 | 1.50 | 464 | 5 | 92.80 |
| LX8 | 1.75 | 980 | 7 | 140.00 |
| LX9 | 2.00 | 935 | 8 | 116.88 |
| LX10 | 2.50 | 503 | 4 | 125.75 |
| LX11 | 3.00 | 859 | 5 | 171.80 |

It will be apparent to those skilled in the art that the novel principles of the invention disclosed herein in connection with specific examples thereof may suggest various other modifications and applications of the same. It is accordingly requested that in construing the breadth of the appended claims they shall not be limited to the specific examples of the invention described herein.

We claim:

1. A blend, consisting of pre-alloyed stainless steel powder consisting essentially of, by weight, up to 0.05% carbon, 22% to 26% chromium, 10% to 24% nickel, 2.7% to 5% molybdenum, 0.1% to 1% boron, up to 2% manganese, up to 2% silicon, balance iron and residuals, together with manganese sulfide particles added thereto essentially, by weight, greater than 0.5% up to 3% of the pre-alloyed stainless steel powder.

2. The blend, according to claim 1, having from 0.75% to 3.0% manganese sulfide added.

3. The blend, according to claim 1, wherein the manganese sulfide particles have a median particle size of approximately 5 microns, and where substantially all such particles are below 12 microns in size.

4. A sintered stainless steel having excellent resistance to corrosive attack by the chloride ion and improved machinability; said steel having an overall composition consisting essentially of, by weight, up to 0.5% carbon, 22% to 26% chromium, 10% to 24% nickel, 2.7% to 5% molybdenum, 0.1% to 1.0% boron, up to 2.0% manganese, up to 2.0% silicon, 0.5% to 3.0% manganese sulfide, balance iron and residuals.

5. The sintered stainless steel, according to claim 4, wherein said steel has a morphology comprised of regions of sintered austenitic stainless steel and regions of solidified liquid phase; said steel having an overall density of at least 95% of full density; said morphology being comprised from 8% to 25% of said liquid phase.

6. The sintered stainless steel, according to claim 4, having from 0.5% to 3.0% of manganese sulfide.

7. The sintered stainless steel, according to claim 4, having from 22.3% to 26% chromium and from 3% to 5% molybdenum.

8. The sintered stainless steel, according to claim 4, having from 0.2% to 0.5% boron.

9. The sintered stainless steel, according to claim 4, having from 22.3% to 26% chromium, from 13% to 18% nickel, from 3% to 5% molybdenum, from 0.2% to 0.5% boron, and from 0.5% to 3.0% manganese sulfide.

10. A method of making sintered stainless steel which comprises the steps of:

(a) providing pre-alloyed stainless steel powder consisting essentially of, by weight, up to 0.05% carbon, 22% to 26% chromium, 10% to 24% nickel, 2.7% to 5% molybdenum, 0.1% to 1.0% boron, up to 2.0% manganese, up to 2.0% silicon, balance iron and residuals;

(b) blending to it manganese sulfide particles, until such particles comprise greater than 0.5% and up to 3% by weight of the resulting blend;

(c) subjecting the resulting blend to at least one pressing; and (d) sintering said press compact in a substantially non-oxidizing atmosphere at a temperature from approximately 2,200 degrees fahrenheit to approximately 2,300 degrees fahrenheit.

11. The method, according to claim 10, wherein the manganese sulfide particles have a median particle size of approximately 5 microns, and where substantially all such particles also are smaller than approximately 12 microns in size.

* * * * *